United States Patent [19]

Sawa et al.

[11] Patent Number: 5,067,991

[45] Date of Patent: Nov. 26, 1991

[54] FE-BASED SOFT MAGNETIC ALLOY

[75] Inventors: Takao Sawa; Masami Okamura, both of Yokohama, Japan

[73] Assignee: Kabushiki Kaisha Toshiba, Kawasaki, Japan

[21] Appl. No.: 362,134

[22] Filed: Jun. 6, 1989

[30] Foreign Application Priority Data

Jun. 13, 1988 [JP] Japan ..... 63-143756

[51] Int. Cl.[5] ..... H01F 1/04

[52] U.S. Cl. ..... 148/305; 148/307; 420/93; 420/118; 420/121; 420/127

[58] Field of Search ..... 148/304, 305, 306, 307; 420/93, 118, 121, 127

[56] References Cited

U.S. PATENT DOCUMENTS 4,581,080 4/1986 Meguro et al. ..... 148/307

FOREIGN PATENT DOCUMENTS 0271657 6/1988 European Pat. Off. ..... 148/305
2539002 8/1976 Fed. Rep. of Germany ..... 148/307
56-133447 10/1981 Japan ..... 148/307
61-288048 12/1986 Japan ..... 148/306
62-167852 7/1987 Japan ..... 148/306
63-239906 10/1988 Japan ..... 148/305
63-302504 12/1988 Japan .

OTHER PUBLICATIONS

Yoshizawa et al., The Japanese Institute of Metals Spring Meeting Digest, Mar. 15, 1988.

*Primary Examiner*—John P. Sheehan
*Attorney, Agent, or Firm*—Finnegan, Henderson, Farabow, Garrett, and Dunner

[57] ABSTRACT

An Fe-based soft magnetic alloy represented substantially by the general formula:

$$Fe_aCu_bV_cSi_dB_e$$

(wherein a, b, c, d, and e are numbers respectively satisfying the following formula:

$$a+b+c+d+e=100 \text{ (atomic percentage)}$$

$$0.01 \leqq b \leqq 3.5$$

$$0.01 \leqq c \leqq 15$$

$$10 \leqq d \leqq 25$$

$$3 \leqq e \leqq 12$$

$$17 \leqq d+e \leqq 30),$$

and the alloy structure thereof having fine crystal grains, for example, in the range of 20 to 95% in area ratio. This Fe-based soft magnetic alloy has high saturation magnetic flux density, and excellent soft magnetic characteristics. Also, it is excellent in the processability and anti-shock properties.

4 Claims, 1 Drawing Sheet

FE-BASED SOFT MAGNETIC ALLOY

FIELD OF THE INVENTION AND RELATED ART STATEMENT

The present invention relates to an Fe-based soft magnetic alloy, and particularly, to an Fe-based soft magnetic alloy suitable to magnetic materials for use as the magnetic cores of various kinds of magnetic heads, high frequency transformers, saturatable reactors, choke coils, etc., and for various kinds of sensors such as current sensors, direction sensors, etc.

Heretofore, as the material for forming magnetic cores used in high frequency regions such as switching regulators and the like, crystalline materials such as permalloy, ferrites, and the like have been used. However, since permalloy has small specific resistance, iron loss in the high frequency range becomes large. Also, although ferrite has small loss for high frequencies, magnetic flux density thereof is also so small as to be at most 5000 G. Therefore, in case when it is used at a large performance magnetic flux density, it becomes nearly saturated, and as a result, iron loss increases.

In recent years, miniaturization of the shape in switching power supply is desired. Therefore, magnetic core devices used in switching power supply such as output choke coils, common mode choke coils, etc, are also desired to be miniaturized. In this case, since the increase of the performance magnetic flux density becomes necessary, the increase of the iron loss of the ferrite becomes a large problem in practical use.

Due to such circumstances, amorphous magnetic alloys having no crystalline structure have assembled notices in recent years, and are partly brought into practical use, since they show excellent soft magnetic properties such as the high magnetic permeability, low coercive force, and the like. Such amorphous magnetic alloys as described above comprise Fe, Co, Ni, etc. as fundamental materials, and include P, C, B, Si, Al, Ge, etc. as non-crystallizing elements (metalloid).

However, it is not true to consider that all of these amorphous magnetic alloys have small iron loss in the high frequency regions. For example, although the Fe-based amorphous alloy is cheap and has small iron loss such as approximately ¼ of that of silicon steel in the low frequency region of 50 to 60 Hz, but on the other hand, it shows a markedly large iron loss in the high frequency region of 10 to 50 KHz, and is by all means unsuitable for use in the high frequency region of the switching regulator and a like.

On the other hand, the Co-based amorphous alloys are in practical use as the magnetic parts of electronic equipment such as the saturatable reactor and the like, since low iron loss and high square ratio can be obtained in the high frequency regions. However, they have such a defect that their price is comparatively high.

Therefore, various attempts are being carried out to improve the characteristics of comparatively inexpensive Fe-based amorphous alloys. For example, trials have been made wherein Fe is replaced with a non-magnetic metal such as Nb, Mo, Cr, etc. to get low iron loss and high permeability, but the effect is not yet sufficient. For example, the deterioration of the magnetic characteristics due to resin mold or the like is also comparatively large, and sufficient characteristics are not yet obtained for them to be soft magnetic materials for use in high frequency regions.

Also, in recent years, there is such a proposal that Cu and a metal selected from Nb, W, Ta, Zr, Hf, Ti, Mo, etc. are added to an Fe-Si-B system alloy, and after once being formed as an amorphous alloy, the product is subjected to heat treatment in a temperature region higher than the crystallization temperature thereof to let fine crystal grains be precipitated. (cf. The Japan Institute of Metals, Spring Meeting digest, March 15, 1988, p. 393; EPO Publication No. 0271657; Japanese Patent Publication No. 63-302504, etc.) This Fe-based alloy is the one in which fine crystal grains are made capable of being formed by adding Cu and Nb or the like to an Fe-Si-B system alloy. Thereby, the saturation magnetic flux density was improved, and soft magnetic characteristics comparable to those of a Co-based amorphous alloy were obtained with the alloy.

Although this advantage is obtained in the manner described above, the following new problem results.

For example, in the case when the alloy is used as a cut core, an amorphous ribbon is wound in a desired shape, and the wound body is subjected to heat treatment to precipitate fine crystal grains, and subsequently, it is cut and processed. However, due to the fact that the above-described Fe-based alloy contains Cu, the alloy structure becomes brittle, and collapse and deformation are liable to occur at the cut terminal part at the time of cutting and processing.

Also, in the case of usual toroidal core or the like, anti-shock properties and anti-oscillation properties becomes insufficient due to the brittleness generated by the addition of Cu, and there remains the room of improvement in the handling properties and in the durability for the shock and oscillation in practical use.

OBJECT AND SUMMARY OF THE INVENTION

Therefore, the object of the present invention resides in providing an Fe-based soft magnetic alloy which shows high saturation magnetic density in the high frequency region, and has excellent soft magnetic characteristics.

Also, another object of the present invention is to provide an Fe-based soft magnetic alloy showing a high saturation magnetic flux density and having excellent soft magnetic properties, and together with that, being excellent in the processability in cutting or the like and in anti-shock properties.

In order to attain the above-described objects, the present inventors have investigated various alloys, and as a result, have at first found that the alloys substantially represented by the general formula:

$$Fe_aCu_bV_cSi_dB_e$$

(wherein, a, b, c, d, and e are numbers respectively satisfy the following formula:

$$a+b+c+d+e=100 \text{ (in atomic percentage) and}$$

$$0.01 \leqq b \leqq 3.5$$

$$0.01 \leqq c \leqq 15$$

$$10 \leqq d \leqq 25$$

$$3 \leqq e \leqq 12$$

$17 \leqq d+e \leqq 30$), and having fine crystal grains, have excellent properties as a soft magnetic material and are excellent in cutting properties and anti-shock properties, in accordance with the present invention.

The Fe-based soft magnetic alloy of the present invention is characterized by having particularly fine crystal grains in an alloy having the above-described composition. These fine crystal grains are preferable to be present in an alloy at the area ratio of more than 25 to 90%, and more preferably, the existence of the crystal grains of less than 300 Å in the above-described fine crystals at the amount of more than 80%.

In the Fe-based soft magnetic alloy of the present invention, Cu is an element which enhances the corrosion resistant properties, and at the same time, prevents the coarsening of the crystal grains, and is effective for improving the soft magnetic properties such as the iron loss and the magnetic permeability. When the content of Cu is too little, the above-described effects can not be obtained, and on the contrary, when the content is too much, the deterioration of the magnetic properties occurs. Due to such a reason, the range of the atomic percentage of 0.01 to 3.5 is suitable for the Cu content. The preferable range is 0.1 to 3 atomic percentage, and more preferable range is 0.5 to 2.6 atomic percentage.

The element V prevents the coarsening of crystal grains by use it together with Cu, and it makes fine crystal grains be uniformly precipitated to decrease magnetostriction and magnetic anisotropy, and is an effective element for the improvement of soft magnetic properties and the improvement of magnetic properties for the temperature change. Also, the element V has not only the above-described improving effect of the magnetic characteristics, but also prevents the brittleness of the alloy structure due to the addition of Cu, and improves the cutting properties, anti-shock properties, and the like, and is a characteristic element of the present invention. When the content of V is too little, the above-described effect cannot be obtained, and when it is too much, amorphous material formation is not carried out in the production procedure, and further, the lowering of the saturated magnetic flux density becomes remarkable. Due to such a fact, the range of 0.01 to 15 atomic percentage is suitable for the content of V. The preferable range is 2 to 10 atomic percentage, and the more preferable range is 5 to 8 atomic percentage.

The elements Si and B are the elements which aid the amorphous material formation and can rise the crystallization temperature, and are effective to the heat treatment for improving the magnetic characteristics.

In particular, Si forms solid solution with Fe which is the main constituent of the fine crystal grains, and contributes to the reduction of magnetostriction and magnetic anisotropy. When its amount is less than 10 atomic percent, the improvement of soft magnetic characteristics is not remarkable, and when it is more than 25 atomic percent, the super cooling effect is small, and comparatively coarse crystal grains of μm level are separated to be unable to obtain good soft magnetic characteristics.

Also, in the case of B, when its amount is less than 3 atomic percent, comparatively coarse crystal grains are separated out and good characteristics can not be obtained, and when its amount is more than 12 atomic percent, a boron compound becomes liable to be separated to deteriorate the soft magnetic characteristics, and is not preferable. By the way, the total amount of Si and B is preferred to be in the range of 17 to 30 atomic percent, and the selection such that $Si/B \geqq 1$ is preferable for obtaining excellent soft magnetic characteristics.

In particular, by making the Si amount be 13 to 21 atomic percent, zero magnetostriction of $\lambda s=0$ is obtained, and the deterioration due to the resin mold becomes absent to enable the effective exhibition of the excellent soft magnetic characteristics of the initial period.

By the way, in the Fe-based soft magnetic alloy of the present invention, although inevitable impurities which are contained in a usual Fe system alloy such as N, O, S, etc. are contained in a minute amount, they do not damage the effect of the present invention.

The Fe-based soft magnetic alloy of the present invention can be obtained, for example, by the following method.

At first, amorphous alloy ribbon is obtained by the liquid quenching method.

Next, for the crystallization temperature of these amorphous alloys, the annealing temperature range of −50° C. to +120° C. is selected, or preferably, the temperature in the range of −30° C. to+100° C. is selected to effect heat treatment for 30 minute to 50 hours, or preferably, for 1 hour to 25 hours to let the intended fine crystals be precipitated.

The fine crystals in the Fe-based soft magnetic alloy of the present invention thus obtained is preferably be present in the range of 25 to 90% in the area ratio. When the area ratio of the fine crystal grains is too small, that is, when the amorphous phase is too much, the iron loss becomes large, magnetic permeability is low, magnetostriction is large, and the deterioration of magnetic characteristics due to the resin mold increases, to become unable to exhibit the effect of the present invention sufficiently. Also, conversely, when the amount is too large, the effect of the precipitate of B compound becomes especially marked, and the magnetic characteristics are deteriorated. As the more preferable existence ratio of the fine crystal grains in the alloy, the area ratio is in the range of 40 to 80%, and in this range, especially stable soft magnetic characteristics can be obtained.

Also, in the above-described fine crystals, when the crystal grain diameter is too large, the deterioration of the magnetic characteristics is introduced. Due to such a fact, it is preferable that crystals having crystal grain diameter of less than 300 Å are present therein for the amount of more than 80%.

Since the Fe-based soft magnetic alloy of the present. invention has excellent soft magnetic characteristics, it exhibits excellent characteristics as an alloy for use in magnetic parts such as the magnetic cores for use in high frequency such as, for example, magnetic heads, thin film heads, high frequency transformers including the ones for use in heavy electric power, saturatable reactors, common mode choke coils, noise filters for high voltage pulse use, laser power sources (MPC circuit), and the like, and as magnetic materials for use in various sensors such as the current sensors, direction sensors, security sensors, and the like.

DETAILED DESCRIPTION OF PREFERRED EMBODIMENTS

Figure 1:
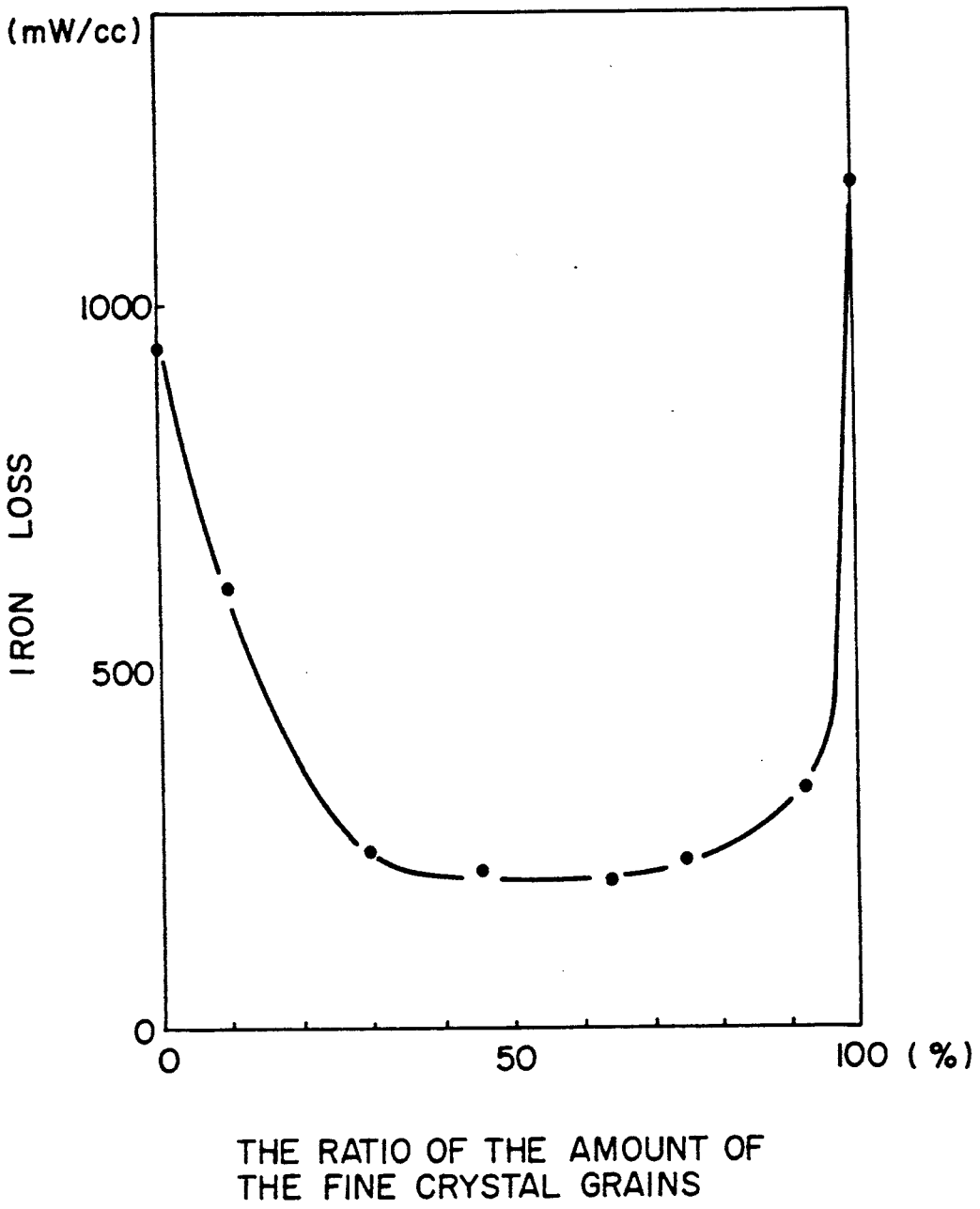
FIG. 1 is a graph for showing the relationship between the ratio of the amount of the fine crystal grains in the Fe-Cu-V-Si-B system alloy and the iron loss.

In the following, the embodiments of the present invention will be explained.

EMBODIMENT 1

An amorphous alloy having the composition represented by the formula:

$Fe_{72}Cu_1V_6Si_{14}B_7$ was made by means of the single roll method to obtain a long ribbon of the dimension of the width 5 mm×plate thickness 14 μm. Next, this ribbon was wound to form a plural number of toroidal magnetic cores having the dimension of outermost diameter 18 mm=inner diameter 12 mm=height 5 mm. For these plural number of toroidal magnetic cores, are applied heat treatment under various kinds of conditions to vary the ratio of separation of the fine crystal grains.

The relationship between the ratio (area %) of the crystal grains in the alloy ribbon constituting respective magnetic cores with changed precipitate ratio of the fine crystal grains thus obtained and the iron loss was examined. The result is shown in FIG. 1. By the way, the precipitate ratio of the crystal grains was obtained by the TEM observation and the like.

As is clear from FIG. 1, in the range where the ratio of the fine crystal grains is in the range of 25 to 90%, the iron loss (100 kHz, 2 kG) decreases to a large extent.

EMBODIMENT 2

By use of the alloys of various compositions as shown in Table 1, amorphous alloy having a thickness of 15 μm were respectively produced by the single roll method.

Next, these ribbons were wound to form toroidal magnetic cores of the size of outermost diameter 18 mm=inner diameter 12 mm=height 5 mm, and heat treatment was effected at the crystallization temperature of respective materials for about 120 minutes (at the temperature raise rate of 10 ° C./min, and the product was subjected to the measurement described in the following.

Also, as a comparison with the above-described embodiment, magnetic cores of amorphous state were prepared by treating the above-described magnetic cores after winding at a temperature lower than the respective crystallization temperatures (measured at the temperature raising rate of 10° C./min.) for about 70° C. for 50 minutes (specimen 1). Also, instead of the one having the V constituent in the above-described embodiment, amorphous alloy was prepared from an alloy used Nb and Ta instead of V under the same composition, and molding and heat treatment were carried out under the same conditions as in the above-described embodiment to produce magnetic cores (samples 2 and 3). Further, magnetic cores with the same shape were produced by using permalloy and sendust (samples 5 and 6).

Resin molding was effected to the respective magnetic cores thus obtained, and the evaluation of the characteristics was carried out for respective products. The results are combinedly shown in Table 1.

1. Existence percentage of crystal grains in the ribbon constituting the magnetic cores The existence ratio (A in the Table) of the crystal grains in the ribbon constituting respective magnetic cores obtained and the ratio of fine crystal grains of less than 300 Å therein were respectively measured by TEM observation and the like, and are shown as the area percentage.

2. Magnetic characteristics

By the use of 5 pieces of the magnetic cores in which the fine crystal grains of the above-described embodiment are present, the magnetic cores shown for comparison and containing no fine crystal grain, and the magnetic cores with changed alloy composition, respectively, the iron loss and magnetic hysteresis at B=2 kG and f=100 kHz, magnetic permeability and saturation magnetic flux density at 1 kHz and 1 m Oe were respectively measured, and the mean values thereof were shown.

Also, for comparison, after obtaining similar magnetic cores as to the amorphous alloy having the composition of $Fe_{79}Si_{10}B_{11}$, the product was heat treated under the conditions of 400 C×2 hours, and magnetic cores in which a gap was formed were obtained by passing through similar processing procedures (sample 4). As to the magnetic cores thus obtained, magnetic characteristics were similarly measured, and the results are shown in Table 1.

By the way, the measurement results show the fluctuation in respective samples of 100 pieces.

TABLE 1

| | Alloy composition | | Existence ratio of crystal grains (Area percentage) | | Magnetic Characteristics | | | |
|---|---|---|---|---|---|---|---|---|
| | No | | A | B | Iron loss (mw/cc) | Magnetostriction (× $10^{-6}$) | Magnetic permeability μ' 1 kHz (× $10^4$) | Saturation magnetic flux density (KG) |
| Example | 1 | $Fe_{72}Cu_1v_6Si_{14}B_7$ | 80 | 90 | 260 | −0 | 8 | 10.9 |
| | 1 | $Fe_{72}Cu_1v_6Si_{14}B_7$ | 0 | 0 | 570 | +13 | 1.2 | 10.9 |
| | 2 | $Fe_{72}Cu_1Nb_6Si_{14}B_7$ | 80 | 80 | 270 | −0 | 7.4 | 10.7 |
| Comparative example | 3 | $Fe_{72}Cu_1Ta_6Si_{14}B_7$ | 80 | 90 | 280 | −0 | 8 | 10.7 |
| | 4 | $Fe_{79}Si_{10}B_{11}$ | 0 | 0 | 3200 | +27 | 0.35 | 15.7 |
| | 5 | Permalloy | — | — | 1000 | −0 | 3 | 7.8 |
| | 6 | Sendust | — | — | 1200 | −0 | 1 | 10.8 |

As can be clearly known from Table 1, the alloy of the above-described embodiment has lower iron loss and lower magnetostriction to show high magnetic permeability in comparison with the magnetic cores of the same composition and the magnetic cores formed of permalloy and the like by being provided with fine crystal grains, and has excellent soft magnetic characteristics in high frequency regions, which are in the same degree as those in a conventional Fe-based soft magnetic alloys (samples 2 and 3) using Nb and Ta in place of V.

Next, magnetic cores were produced by carrying out formation and heat treatment for the alloys for which the Cu content in the alloys having respective compositions of the sample 1 of the Example and samples 2 and 3 of the Comparative Example shown in Table 1 respectively, under the same conditions as in Table 1.

By using 100 pieces of above-described samples, respectively, after impregnating resin therein, they were cut at a position in the radial direction to form a gap of width of 1 mm.

The inductance of the magnetic cores obtained having a gap was measured under the conditions of the winding number of 10 turns and the voltage of 1 V. The results obtained are shown with the values of the magnetic permeability ($\mu'$) at 1 kHz in Table 2.

TABLE 2

| | No | Alloy composition | Existence ratio of crystal grains (Area percentage) A | B | Magnetic permeability after cut processing $\mu'$ 1 kHz |
|---|---|---|---|---|---|
| Example | 1 | $Fe_{72}Cu_1V_6Si_{14}B_7$ | 80 | 90 | 150 ± 3 |
| | 7 | $Fe_{71}Cu_2V_6Si_{14}B_7$ | 80 | 90 | 150 ± 3 |
| | 8 | $Fe_{71}Cu_{2.5}V_6Si_{13.5}B_7$ | 80 | 100 | 150 ± 3 |
| Comparative example | 2 | $Fe_{72}Cu_1Nb_6Si_{14}B_7$ | 80 | 80 | 147 ± 6 |
| | 3 | $Fe_{72}Cu_1Ta_6Si_{14}B_7$ | 80 | 90 | 147 ± 6 |
| | 9 | $Fe_{71}Cu_2Nb_6Si_{14}B_7$ | 70 | 90 | 142 + 5/−10 |
| | 10 | $Fe_{71}Cu_2Ta_6Si_{14}B_7$ | 80 | 90 | 142 + 3/−8 |
| | 11 | $Fe_{71}Cu_{2.5}Nb_6Si_{13.5}B_7$ | 80 | 100 | 140 + 5/−10 |
| | 12 | $Fe_{71}Cu_{2.5}Ta_6Si_{13.5}B_7$ | 80 | 100 | 140 + 5/−10 |

The magnetic cores using the alloys of respective embodiments shown in the above-described Table 2 show excellent characteristics even after the formation of the gap, but on the contrary, in the magnetic cores of the samples 2, 3, and 9 to 12 shown as comparative examples, there are observed the lowering of impedance and the occurrence of fluctuation. This is due to the fact that the alloys of the present invention have strong anti-brittleness properties and there is almost no crack of the ribbon in the vicinity of the gap in the cutting in the time of formation of the gap.

EMBODIMENT 3

The alloys of respective compositions shown in Table 3 were quenched by the single roll method, and amorphous alloy ribbon of width of 10 mm × thickness of 20 μm were produced. By the way, any of these ribbons was capable of being bended to 180°. Successively, these ribbons were formed into toroidal-like magnetic cores of outermost diameter 28 mm = inner diameter 18 mm = height 10 mm, and the products were subjected to the optimum heat treatment between the first crystallization peak temperature and the second crystallization peak temperature.

Next, these magnetic cores were put in cases, and were dropped 10 times from the height of 1 m down to concrete floor, and the total magnetic flux amount at the time before and after the dropping was measured. The results are shown combinedly in Table 3. By the way, the results of measurements are shown in mean values of the magnetic flux amount variation rates of the respective ones of 100 pieces.

TABLE 3

| | Alloy composition | Magnetic flux amount variation ratio $\phi/\phi^*$ |
|---|---|---|
| Example | $Fe_{72}Cu_1V_6Si_{13}B_8$ | 0.98 |
| | $Fe_{72}Cu_2V_6Si_{13}B_7$ | 0.96 |
| | $Fe_{72}Cu_{1.5}V_{5.5}Si_{14}B_7$ | 0.98 |
| Comparative example | $Fe_{72}Cu_1Nb_5Si_{14}B_8$ | 0.90 |
| | $Fe_{70}Cu_2Ta_5Si_{17}B_6$ | 0.87 |
| | $Fe_{72}Cu_{1.5}Mo_6Si_{14}B_{6.5}$ | 0.90 |

As is clearly known from the above-described Table 3, there is shown that the magnetic cores by use of the alloy of the embodiment have extremely small change of total magnetic flux amount, and the crack of the core is almost none. On the contrary, it is shown that the magnetic cores of the comparative example have a large amount of change, and lack anti-shocking properties and are brittle. By the way, when confirmation was effected by taking out these magnetic cores from the cases, it was confirmed that, in the magnetic cores with a large amount of change, there were many cracks.

Also, in the alloy having the composition of $Fe_{75}Cu_2Si_{13}B_{10}$, it is difficult to effect comparison under the same conditions, since the characteristics deteriorate to a large extent by being subjected to crystallization, so that they were heat treated under the same conditions and were subjected to the same measurement, and the cracks of the magnetic cores were extremely many.

As can be clearly known from the above-described embodiments, the Fe-based soft magnetic alloy of the present invention becomes to have large saturation magnetic flux density in high frequency regions, excellent soft magnetic characteristics, and also, excellent processability and anti-shock properties by using V together with Cu. Thus, the Fe-based soft magnetic alloy of the present invention is the one in which the defect of the conventional soft magnetic alloys of the Fe-Cu-Nb-Si-B system that they are brittle has been improved without damaging magnetic characteristics. Therefore, it is a practically extremely effective soft magnetic alloy as one of various kinds of magnetic materials used in high frequency regions.

What is claimed is:

1. An Fe-based soft magnetic alloy having high saturation magnetic flux density and excellent soft magnetic characteristics, said alloy consisting of a composition represented by the general formula:

$$Fe_aCu_bV_cSi_dB_e$$

(wherein a, b, c, d, and e are number respectively satisfying the following equations:

$$a+b+cfd+e=100 \text{(atomic percentage)}$$

$$0.01 \leqq b \leqq 3.0$$

$$5 \leqq c \leqq 15$$

$$10 \leqq d \leqq 25$$

$$3 \leqq e \leqq 12$$

$17 \leqq d+e \leqq 30$), and having fine crystal grains.

2. The Fe-based soft magnetic alloy of claim 1, wherein said fine crystal grains are present in the alloy in an area ratio thereof of 25 to 90%, with more than 80% of the fine crystal grains having a diameter of less than 300 Å.

3. The Fe-based soft magnetic alloy of claim 2, wherein said alloy, other than said fine crystal grains, is amorphous.

4. The Fe-based soft magnetic alloy of claims 1, 2, or 3, wherein b, c, d, and e satisfy the following equations b, c, d, and e satisfy the following equations:

$$0.1 \leqq b \leqq 3$$

$$5 \leqq c \leqq 8$$

$$13 \leqq d \leqq 21$$

$$3 \leqq e \leqq 12.$$

* * * * *